US007243594B2

(12) United States Patent
Holtz

(10) Patent No.: US 7,243,594 B2
(45) Date of Patent: Jul. 17, 2007

(54) ROTARY ACTUATOR

(75) Inventor: Todd Granger Holtz, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 11/366,892

(22) Filed: Mar. 1, 2006

(65) Prior Publication Data

US 2006/0196352 A1 Sep. 7, 2006

Related U.S. Application Data

(60) Provisional application No. 60/658,254, filed on Mar. 3, 2005.

(51) Int. Cl.
*F15B 15/12* (2006.01)
*F15B 15/08* (2006.01)

(52) U.S. Cl. ..... 92/120

(58) Field of Classification Search ..... 92/67, 92/120, 130 R, 130 C
See application file for complete search history.

(56) References Cited

U.S. PATENT DOCUMENTS

| | | | | |
|---|---|---|---|---|
| 5,235,900 | A * | 8/1993 | Garceau | 92/120 |
| 5,996,523 | A * | 12/1999 | Fox | 92/120 |
| 6,571,682 | B2 * | 6/2003 | Roberts et al. | 92/120 |
| 6,668,777 | B2 * | 12/2003 | Sluka et al. | 92/120 |
| 6,865,982 | B2 * | 3/2005 | Bunyard et al. | 92/120 |

FOREIGN PATENT DOCUMENTS

EP 386598 A1 * 9/1990

* cited by examiner

*Primary Examiner*—Thomas E. Lazo
(74) *Attorney, Agent, or Firm*—Duane Morris LLP

(57) ABSTRACT

The present invention relates to the field of rotary actuators. Specifically, the present invention relates to rotary actuators comprising a rotatable top piston assembly and a stationary bottom piston assembly wherein rotation of the top piston assembly can be caused by pressurizing one or more cavities between the top and bottom piston assemblies.

20 Claims, 8 Drawing Sheets

ROTARY ACTUATOR

PRIORITY INFORMATION

This application claims the benefit of U.S. Provisional Application No. 60/658,254, filed on Mar. 3, 2005.

BACKGROUND OF THE INVENTION

1. Field of the Invention

The present invention relates to the field of rotary actuators. Specifically, the present invention relates to rotary actuators comprising a rotatable top piston assembly and a stationary bottom piston assembly wherein rotation of the top piston assembly can be caused by pressurizing one or more cavities between the top and bottom piston assemblies.

2. Description of the Prior Art

A prior art rotary actuator is disclosed in U.S. Pat. No. 5,235,900 to Garceau.

DESCRIPTION OF THE PREFERRED EMBODIMENTS

Two embodiments described herein are a two piston embodiment comprising one upper piston and one lower piston, and a four piston embodiment comprising one pair of upper pistons and one pair of lower pistons. Those of ordinary skill in the art will understand that additional embodiments comprising equal numbers of upper pistons and lower pistons may be made using the principals disclosed herein. For each such embodiment, the number of pressurization cavities will equal the number of pistons.

A first embodiment to the present invention is the four piston embodiment depicted in FIGS. 1-4. This embodiment comprises a lower housing 18 comprising a central channel, a mounting surface 17 and an outer wall 19. In a preferred embodiment, the lower housing is cylindrical.

Figure 1:
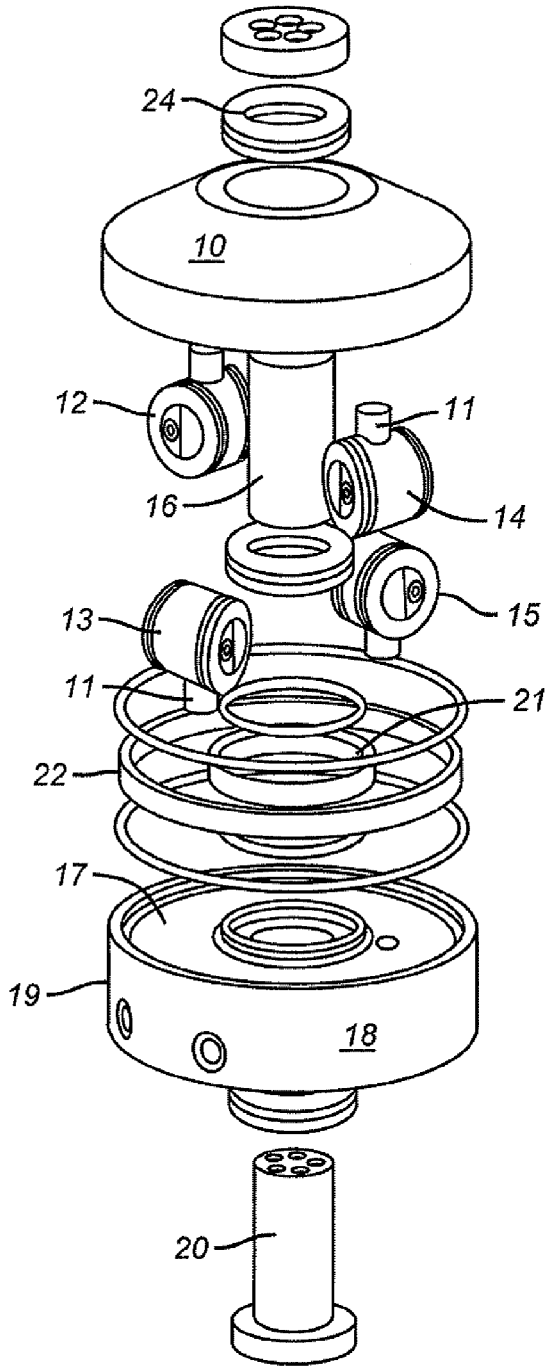
FIG. 1 is an exploded isometric view of a first embodiment of the present invention.
Figure 4:
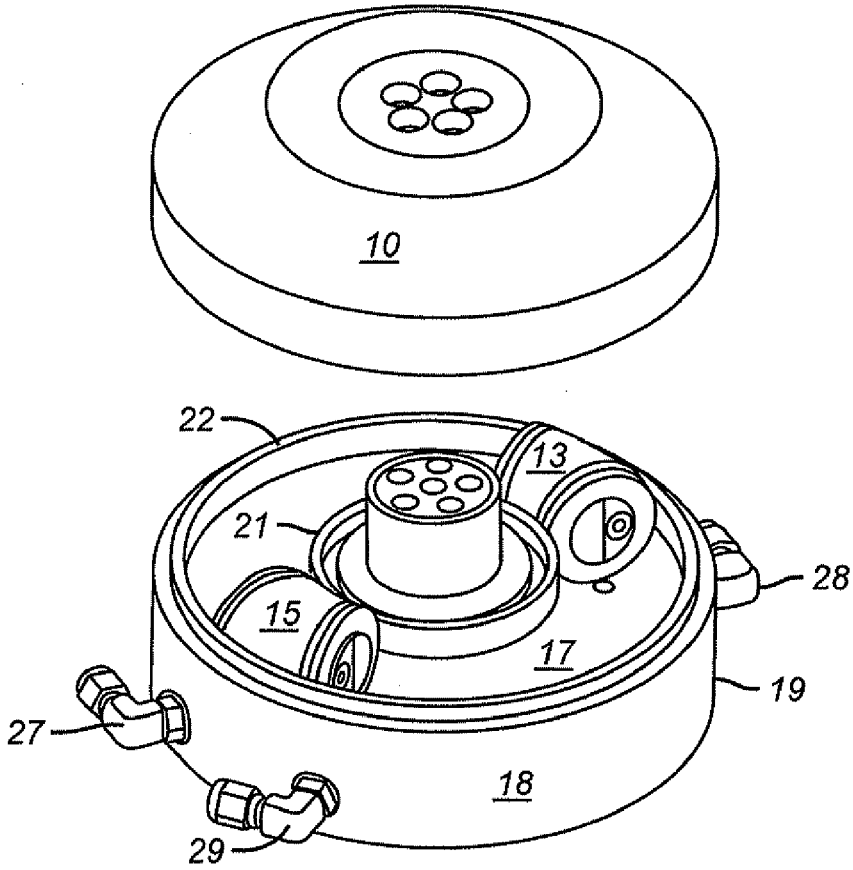
FIG. 4 is a partially exploded isometric view of a first embodiment of the present invention.

This embodiment of the invention further comprises a first lower piston 13 attached to, and extending above, the mounting surface, and a second lower piston 15 attached to, and extending above, the mounting surface diametrically opposite the first lower piston. The term "diametrically opposite", as used herein, is used in its broadest sense. It encompasses two pistons that are located on opposite sides of an axis which bisects the lower housing into two regions of equivalent area. Where the lower housing is cylindrical, such an axis would define the diameter of the housing. In a preferred embodiment, the first and second lower pistons are cylindrical. In another preferred embodiment, the first and second lower pistons are attached to the mounting surface by pins 11. As shown in FIGS. 1 and 4, the lower housing comprises inner seal ring 21 located radially inside the first and second lower pistons, and outer seal ring 22 located radially outside the first and second lower pistons. In a preferred embodiment, the inner and outer seal rings have a dovetailed configuration to enable them to resist collapsing into the piston bore from operational pressure.

This embodiment further comprises a rotatable central shaft 20 extending upward through the central channel and an upper housing 10 attached to the shaft above the lower housing. In a preferred embodiment, the upper housing has an outer diameter equal to the outer diameter of the lower housing.

This embodiment further comprises a first upper piston 12 attached to, and extending below, the upper housing at a location between the first and second lower pistons so as to define a first pressure cavity 32 between the itself and the first lower piston, and to define a second pressure cavity 34 between the itself and the second lower piston. This embodiment further comprises a second upper piston 14 attached to, and extending below, the upper housing at a location between the first and second lower pistons, diametrically opposite the first upper piston, so as to define a third pressure cavity 36 between the itself and the first lower piston, and to define a fourth pressure cavity 38 between the itself and the second lower piston. In a preferred embodiment, the first and second upper pistons are cylindrical. In another preferred embodiment, the cross sectional area of the first upper piston, second upper piston, first lower piston, and second lower piston are substantially equal. In another preferred embodiment, the first and second upper pistons are attached to the upper housing by pins 11.

This embodiment further comprises a first pressurization line 26 extending through the outer wall to the side of the first lower piston adjacent the first pressure cavity, such that fluid can be injected into the first pressure cavity 32 through the first pressurization line to cause the first upper piston to move away from the first lower piston. This embodiment further comprises a second pressurization line 28 extending through the outer wall to the side of the first lower piston adjacent the third pressure cavity, such that fluid can be injected into the third pressure cavity 36 through the second pressurization line to cause the second upper piston to move away from the first lower piston. In a preferred embodiment, the first and second pressurization lines have substantially equivalent internal diameters.

This embodiment further comprises a third pressurization line 27 extending through the outer wall to the side of the second lower piston adjacent the second pressure cavity, such that fluid can be injected into the second pressure cavity 34 through the third pressurization line to cause the first upper piston to move away from the second lower piston. This embodiment further comprises a fourth pressurization line 29 extending through the outer wall to the side of the second lower piston adjacent the fourth pressure cavity, such that fluid can be injected into the fourth pressure cavity 38 through the fourth pressurization line to cause the second upper piston to move away from the second lower piston. In a preferred embodiment, the third and fourth pressurization lines have substantially equivalent internal diameters. In another preferred embodiment, the first, second, third, and fourth pressurization lines have substantially equivalent internal diameters.

Figure 2:
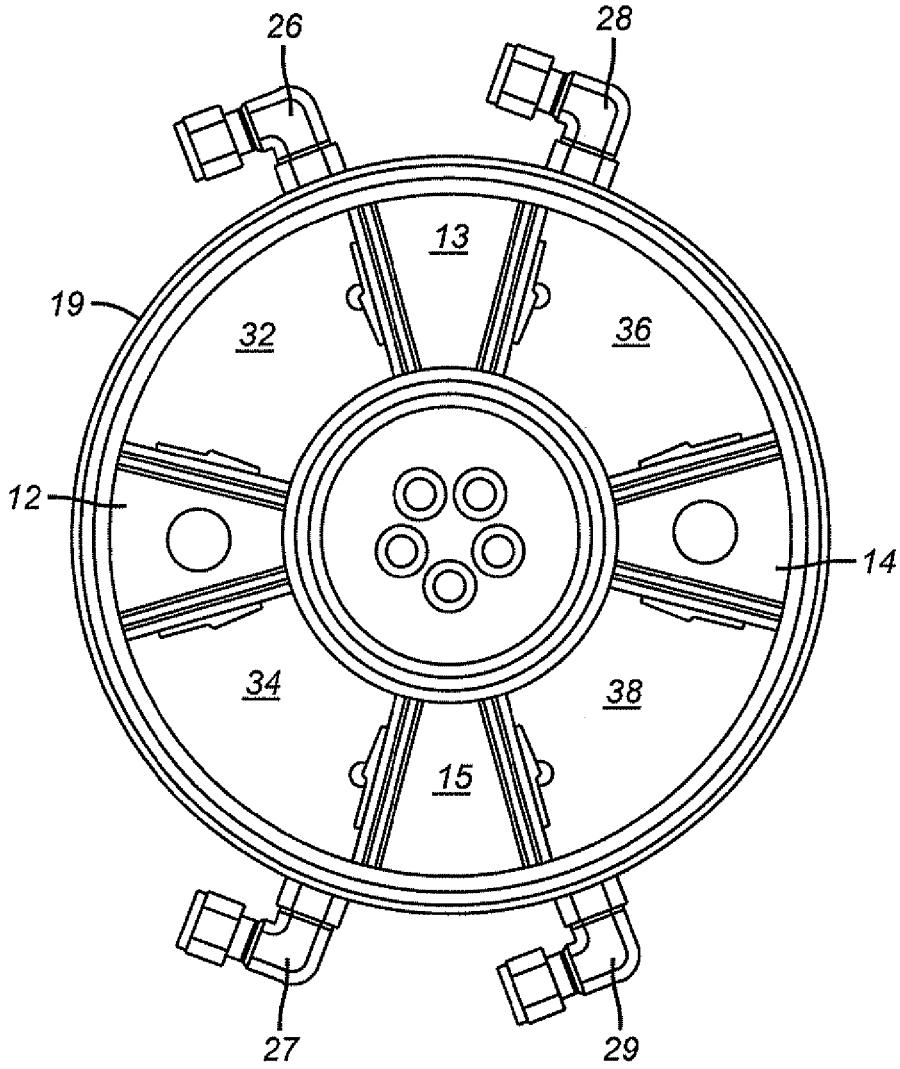
FIG. 2 is a top internal view of a first embodiment of the present invention excluding the upper housing in a first position.

In FIG. 2, the first upper piston 12 and the second upper piston 14 are shown in a first position with respect to the first lower piston 13 and the second lower piston 15. In this first position, pressure cavities 32, 34, 36, and 38 are of substantially equivalent size. If the first pressure cavity 32 or the fourth pressure cavity 38 is pressurized by injecting fluid through the first pressurization line 26 or the fourth pressurization line 29, respectively, the resulting pressurization will result in a counterclockwise rotation of the first and second upper pistons relative to the first and second lower pistons, resulting in the pistons being located in a second position as shown in FIG. 3.

Figure 3:
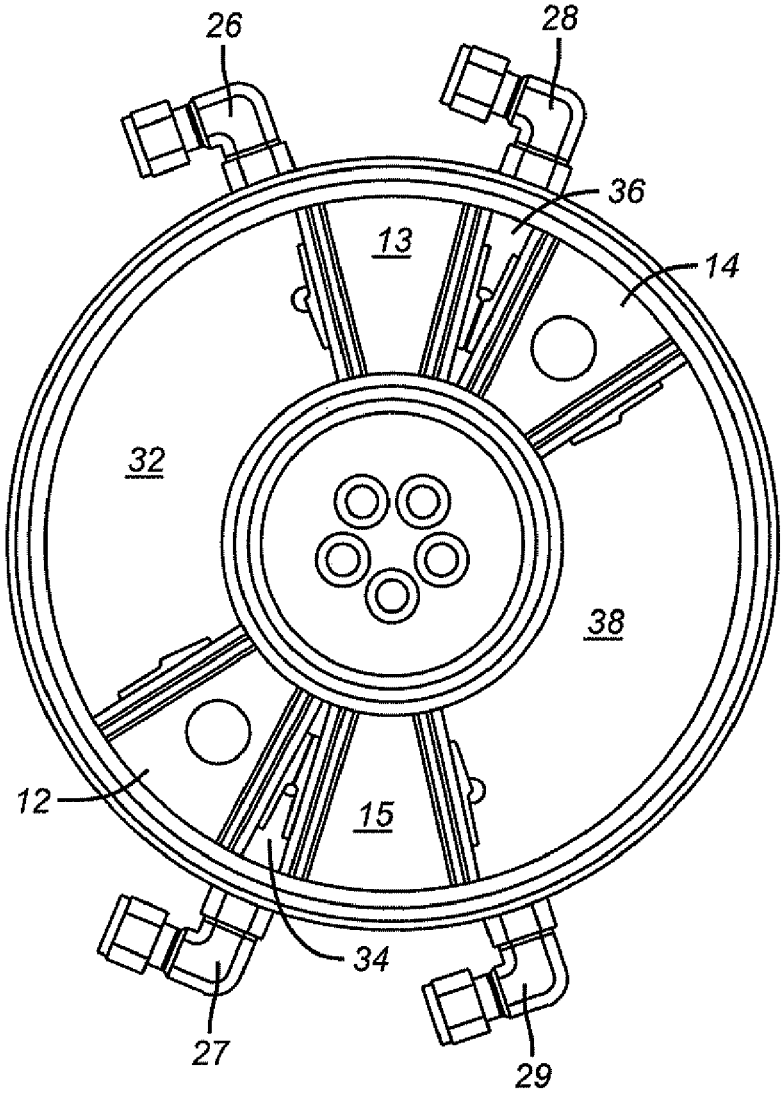
FIG. 3 is a top view of a first embodiment of the present invention in a second position.

In a preferred embodiment, the first pressure cavity 32 and the fourth pressure cavity 38 are simultaneously pressurized by injecting fluid through the first pressurization line 26 and the fourth pressurization line 29 to cause rotation of the first upper piston 12 and the second upper piston 14 from the first position shown in FIG. 2 to the second position shown in FIG. 3. In the pressurization operations described above, when fluid is injected into first pressurization line 26, it is vented through the second pressurization line 28. When fluid is injected into the fourth pressurization line 29, it is vented through the third pressurization line 27.

When the pistons are in the second position shown in FIG. 3, clockwise rotation of the first upper piston 12 and the second upper piston 14 can be caused by pressurizing the third pressure cavity 36 and/or the second pressure cavity 34 through the second pressurization line 28 and/or the third pressurization line 27, respectively. Alternatively, these lines can be pressurized simultaneously to achieve this clockwise rotation. When the second and third pressurization lines are operated in this manner, fluid is vented through the first pressurization line 26 and the fourth pressurization line 29, respectively.

Persons of ordinary skill in the art will understand that a source of pressurization fluid, such as hydraulic fluid, may be coupled to each pressurization line via a control valve system so that the pressurization and venting operations described herein may be selectively achieved and reciprocated by operation of flow control valves installed in fluid communication between the reservoir of pressurization fluid and the first, second, third, and fourth pressurization lines. For a given embodiment having a set number of pistons, the longitudinal length of the pistons determines the pistons stroke and the degrees of rotation involved in traveling from a first position to a second position. As the number of pistons increases, the magnitude of piston stroke decreases for the same diameter rotary actuator of the present invention.

This embodiment further comprises a bearing 24 mounted to the shaft and the upper housing. In a preferred embodiment, the bearing is a thrust bearing, as shown in FIG. 1.

A second embodiment of the present invention is the two piston embodiment disclosed in FIGS. 5-8. This embodiment comprises a lower housing 48 comprising a central channel, a mounting surface 47 and an outer wall 49.

This embodiment further comprises a lower piston 43 attached to, and extending above, the mounting surface. This embodiment further comprises a rotatable central shaft 50 extending upward through the central channel, and an upper housing 40 attached to the shaft above the lower housing 48. The lower housing 48 comprises an inner seal ring 41 located radially inside the first and second lower pistons, and an outer seal ring 42 located radially outside the first and second lower pistons. In a preferred embodiment, the inner and outer seal rings have a dovetailed configuration to enable them to resist collapsing into the piston bore from operational pressure.

Figure 6:
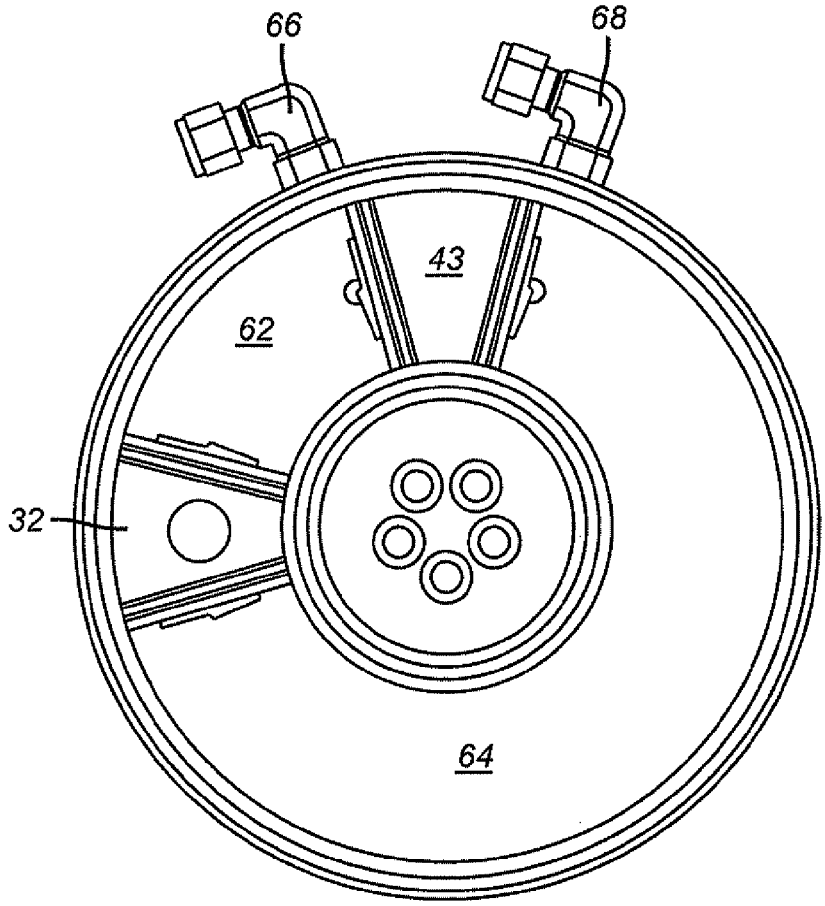
FIG. 6 is a top internal view of a second embodiment of the present invention excluding the upper housing in a first position.

This embodiment further comprises an upper piston 32 attached to, and extending below, the upper housing at a location diametrically opposite the lower piston so as to define a first pressure cavity 62 and a second pressure cavity 64 between itself and the lower piston, as shown in FIG. 6.

Figure 7:
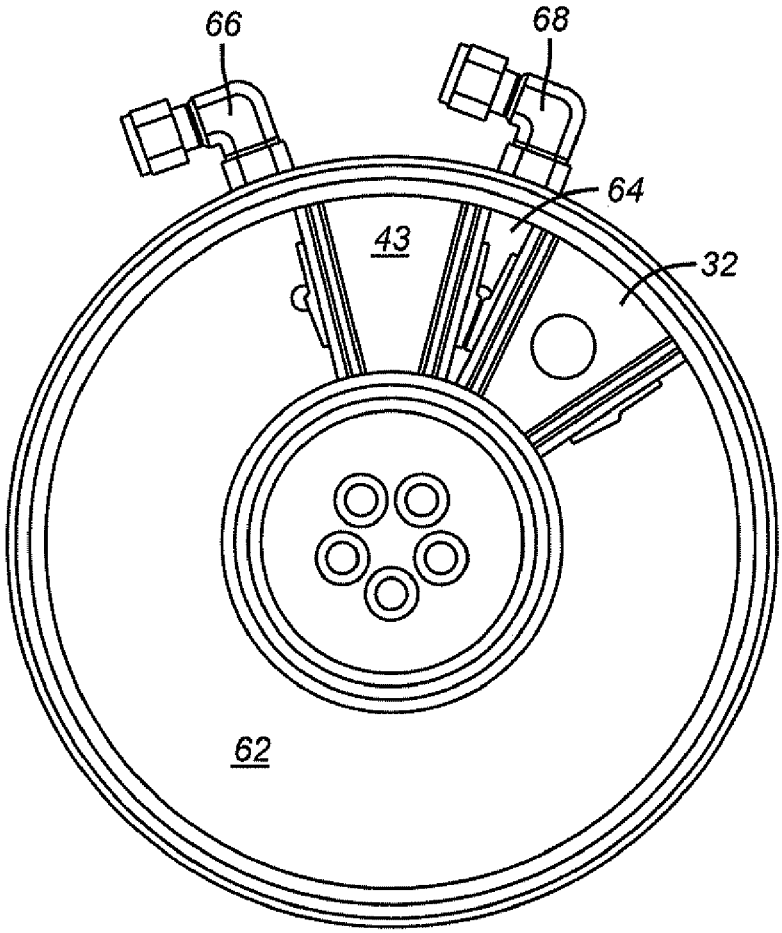
FIG. 7 is a top view of a second embodiment of the present invention in a second position.
Figure 8:
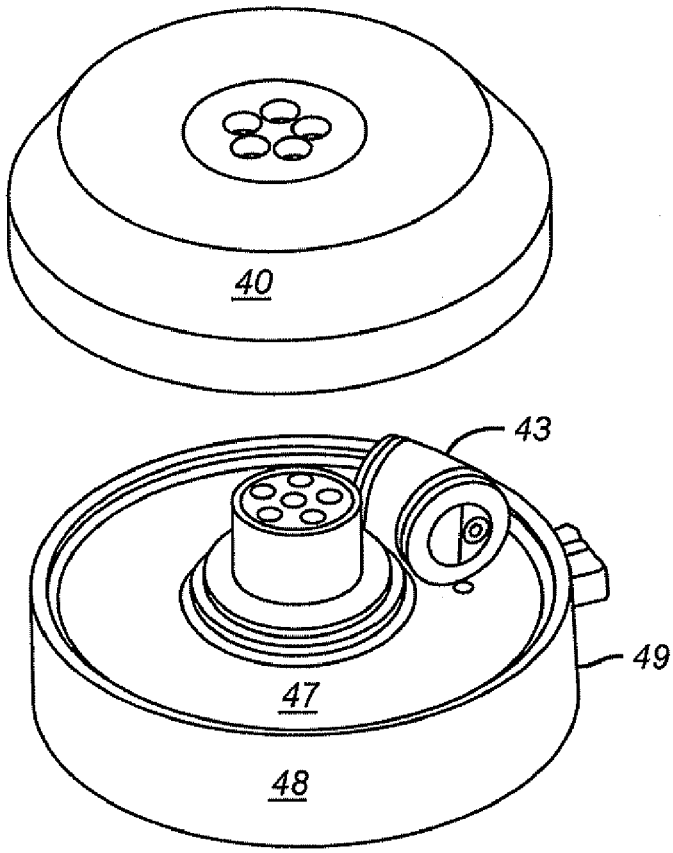
FIG. 8 is a partially exploded isometric view of a second embodiment of the present invention.

This embodiment further comprises a first pressurization line 66 extending through the outer wall to the side of the lower piston adjacent the first pressure cavity 62, such that fluid can be injected into the first pressure cavity 62 through the first pressurization line 66 to cause the upper piston to move away from the lower piston, such that the volume of first pressure cavity 62 increases, as shown in FIG. 7.

This embodiment further comprises a second pressurization line 68 extending through the outer wall to the side of the lower piston adjacent the second pressure cavity 64, such that fluid can be injected into the second pressure cavity 64 through the second pressurization line 68 to cause the upper piston to move away from the lower piston, such that the volume of second pressure cavity 64 increases.

Figure 5:
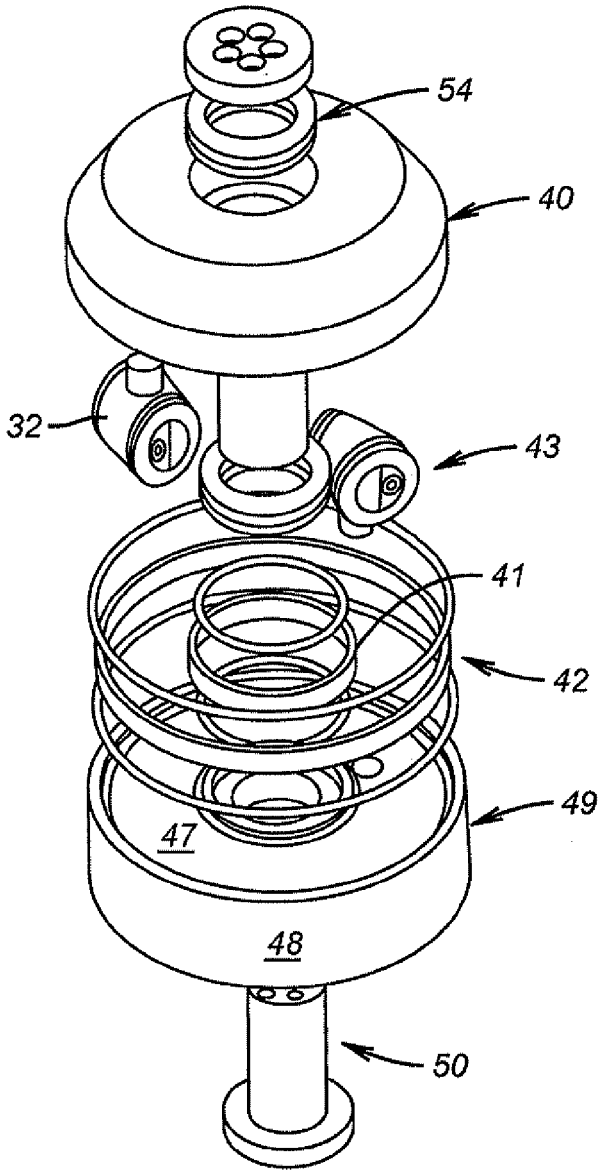
FIG. 5 is an exploded isometric view of a second embodiment of the present invention.

Persons of ordinary skill in the art will understand that a source of pressurization fluid, such as hydraulic fluid, may be coupled to each pressurization line in this two piston embodiment via a control valve system so that the pressurization and venting operations described herein may be selectively achieved and reciprocated by operation of flow control valves installed in fluid communication between the reservoir of pressurization fluid and the first and second pressurization lines. In a preferred embodiment, the first and second pressurization lines have substantially equivalent internal diameters. This embodiment further comprises a bearing 54 mounted to the shaft and the upper housing. In a preferred embodiment, the bearing is a thrust bearing, as shown in FIG. 5.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A rotary actuator comprising:

a. a lower housing comprising a central channel, a mounting surface and an outer wall;

b. a first lower piston attached to, and extending above, the mounting surface;

c. a second lower piston attached to, and extending above, the mounting surface diametrically opposite the first lower piston;

d. a rotatable central shaft extending upward through the central channel;

e. an upper housing attached to the shaft above the lower housing;

f. a first upper piston attached to, and extending below, the upper housing at a location between the first and second lower pistons so as to define a first pressure cavity between the itself and the first lower piston, and to define a second pressure cavity between the itself and the second lower piston;

g. a second upper piston attached to, and extending below, the upper housing at a location between the first and second lower pistons, diametrically opposite the first upper piston, so as to define a third pressure cavity between the itself and the first lower piston, and to define a fourth pressure cavity between the itself and the second lower piston;

h. a first pressurization line extending through the outer wall to the side of the first lower piston adjacent the first pressure cavity, such that fluid can be injected into the first pressure cavity through the first pressurization line to cause the first upper piston to move away from the first lower piston;

i. a second pressurization line extending through the outer wall to the side of the first lower piston adjacent the third pressure cavity, such that fluid can be injected into the third pressure cavity through the second pressurization line to cause the second upper piston to move away from the first lower piston;

j. a third pressurization line extending through the outer wall to the side of the second lower piston adjacent the second pressure cavity, such that fluid can be injected into the second pressure cavity through the third pressurization line to cause the first upper piston to move away from the second lower piston;

k. a fourth pressurization line extending through the outer wall to the side of the second lower piston adjacent the fourth pressure cavity, such that fluid can be injected into the fourth pressure cavity through the fourth pressurization line to cause the second upper piston to move away from the second lower piston;

l. a bearing mounted to the shaft and the upper housing;

m. an inner seal ring located radially inside the first and second lower pistons; and n. an outer seal ring located radially outside the first and second lower pistons.

2. The rotary actuator of claim 1, wherein the lower housing is cylindrical.

3. The rotary actuator of claim 1, wherein the first and second lower pistons are cylindrical.

4. The rotary actuator of claim 1, wherein the first and second lower pistons are attached to the mounting surface by pins.

5. The rotary actuator of claim 1, wherein the inner and outer seal rings comprise a dovetail configuration.

6. The rotary actuator of claim 1, wherein the first and second upper pistons are cylindrical.

7. The rotary actuator of claim 1, wherein the cross sectional area of the first upper piston, second upper piston, first lower piston, and second lower piston are substantially equal.

8. The rotary actuator of claim 1, wherein the first, second, third and fourth pressurization lines have substantially equivalent internal diameters.

9. The rotary actuator of claim 1, further comprising:

a. a source of pressurization fluid coupled to each pressurization line; and b. a control valve system installed in fluid communication with the source of pressurization fluid and each pressurization line.

10. The rotary actuator of claim 1, wherein the bearing is a thrust bearing.

11. A rotary actuator comprising:

a. a lower housing comprising a central channel, a mounting surface and an outer wall;

b. a lower piston attached to, and extending above, the mounting surface;

c. a rotatable central shaft extending upward through the central channel;

d. an upper housing attached to the shaft above the lower housing;

e. an upper piston attached to, and extending below, the upper housing at a location diametrically opposite the lower piston so as to define a first pressure cavity and a second pressure cavity between itself and the lower piston;

f. a first pressurization line extending through the outer wall to the side of the lower piston adjacent the first pressure cavity, such that fluid can be injected into the first pressure cavity through the first pressurization line to cause the upper piston to move away from the first lower piston;

g. a second pressurization line extending through the outer wall to the side of the lower piston adjacent the second pressure cavity, such that fluid can be injected into the second pressure cavity through the second pressurization line to cause the upper piston to move away from the lower piston;

h. a bearing mounted to the shaft and the upper housing;

i. an inner seal ring located radially inside the first and second lower pistons; and j. an outer seal ring located radially outside the first and second lower pistons.

12. The rotary actuator of claim 11, wherein the first and second pressurization lines have substantially equivalent internal diameters.

13. The rotary actuator of claim 11, wherein the bearing is a thrust bearing.

14. The rotary actuator of claim 11, wherein the lower housing is cylindrical.

15. The rotary actuator of claim 11, further comprising:

a. a source of pressurization fluid coupled to each pressurization line; and b. a control valve system installed in fluid communication with the source of pressurization fluid and each pressurization line.

16. A rotary actuator comprising:

a. a lower housing comprising a central channel, a mounting surface and an outer wall;

b. a lower piston attached to, and extending above, the mounting surface;

c. a rotatable central shaft extending upward through the central channel;

d. an upper housing attached to the shaft above the lower housing;

e. an upper piston attached to, and extending below, the upper housing at a location diametrically opposite the lower piston so as to define a first pressure cavity and a second pressure cavity between itself and the lower piston;

f. a first pressurization line extending through the outer wall to the side of the lower piston adjacent the first pressure cavity, such that fluid can be injected into the first pressure cavity through the first pressurization line to cause the upper piston to move away from the first lower piston; and g. a second pressurization line extending through the outer wall to the side of the lower piston adjacent the second pressure cavity, such that fluid can be injected into the second pressure cavity through the second pressurization line to cause the upper piston to move away from the lower piston.

17. The rotary actuator of claim 16, wherein the lower piston and upper piston are cylindrical.

18. The rotary actuator of claim 16, wherein the lower piston and upper piston are attached to the mounting surface by pins.

19. The rotary actuator of claim 16, wherein the cross sectional area of the lower piston and upper piston are substantially equal.

20. The rotary actuator of claim 16, further comprising:

a. a source of pressurization fluid coupled to each pressurization line; and b. a control valve system installed in fluid communication with the source of pressurization fluid and each pressurization line.

* * * * *